US010085547B1

(12) United States Patent
Cummings

(10) Patent No.: US 10,085,547 B1
(45) Date of Patent: Oct. 2, 2018

(54) STEP BIT POUCH

(71) Applicant: Kareem Cummings, Yonkers, NY (US)

(72) Inventor: Kareem Cummings, Yonkers, NY (US)

( * ) Notice: Subject to any disclaimer, the term of this patent is extended or adjusted under 35 U.S.C. 154(b) by 121 days.

(21) Appl. No.: 15/201,881

(22) Filed: Jul. 5, 2016

(51) Int. Cl.
*A45F 5/00* (2006.01)
*A45F 5/02* (2006.01)
*B25H 3/00* (2006.01)

(52) U.S. Cl.
CPC ..... *A45F 5/021* (2013.01); *B25H 3/003* (2013.01)

(58) Field of Classification Search
CPC ..... A45F 5/021; B25H 3/003
USPC ..... 224/240
See application file for complete search history.

(56) References Cited

U.S. PATENT DOCUMENTS 1,282,695 A * 10/1918 Jennings ..... F42B 39/02 224/240
1,648,565 A * 11/1927 Primley ..... A63B 47/00 150/112
2,413,580 A * 12/1946 Perry ..... F42B 39/02 206/3
2,625,192 A * 1/1953 Kinskie ..... A45F 5/02 206/703
2,700,492 A * 1/1955 Baetzing ..... A45C 11/34 224/240
2,758,798 A * 8/1956 Schmidt ..... B25H 3/00 206/234
D214,984 S * 8/1969 Woolfolk ..... 224/240
3,813,017 A * 5/1974 Pimsleur ..... A45C 11/38 206/316.2
4,047,650 A * 9/1977 Domingos ..... A45F 5/02 224/223
4,101,025 A * 7/1978 Jordan ..... A45C 11/00 206/377
4,264,024 A * 4/1981 Harris, Jr. ..... A24F 9/14 131/260
4,508,221 A * 4/1985 Olson ..... B25F 5/029 206/371
4,852,783 A * 8/1989 Bryden ..... A45C 7/0095 150/149
D306,654 S * 3/1990 Brown ..... D3/218
D359,165 S 6/1995 Kaiser, III
5,501,379 A 3/1996 Munoz
D378,633 S * 4/1997 Granito ..... D3/228
5,779,122 A * 7/1998 Martinelli ..... A45C 11/24 224/222
5,842,584 A 12/1998 Baird
6,196,431 B1 * 3/2001 Underhill ..... A45F 5/02 224/237

(Continued)

*Primary Examiner* — Peter Helvey
(74) *Attorney, Agent, or Firm* — Kyle A. Fletcher, Esq.

(57) ABSTRACT

The step bit pouch is adapted for use with a plurality of step bits and a pilot bit. The step bit pouch is adapted for use with a belt. The step bit pouch is a holster that is designed to hold the plurality of step bits and the pilot bit. Each of the plurality of step bits is differentiated by their size. The intention of the step bit pouch is to provide a craftsman, such as an electrician, who only occasionally needs to work with sheet metal, a small, light, and convenient means to carry only the drill bits required for punching holes in sheet metal. The step bit pouch comprises a first textile or sheeting, a second textile or sheeting, a third textile or sheeting, a fourth textile or sheeting, a plurality of seams, and a fastener.

18 Claims, 6 Drawing Sheets

(56) References Cited

U.S. PATENT DOCUMENTS

| | | | | |
|---|---|---|---|---|
| D443,411 | S * | 6/2001 | Snider | D3/228 |
| 6,244,486 | B1 * | 6/2001 | Holland | A45F 5/02 224/223 |
| 6,257,473 | B1 * | 7/2001 | Ringelstetter | E01H 1/1206 119/795 |
| 6,561,402 | B2 * | 5/2003 | Holland | A45F 5/00 224/192 |
| 6,651,854 | B1 * | 11/2003 | LaCoste | A45F 5/00 224/196 |
| 6,729,480 | B1 | 5/2004 | Blake | |
| 7,011,241 | B2 * | 3/2006 | Godshaw | A45C 7/0086 224/583 |
| 7,621,396 | B1 | 11/2009 | Flores | |
| D684,764 | S * | 6/2013 | Sigouin | D3/228 |
| 8,899,458 | B1 * | 12/2014 | Heien | A45F 5/021 224/236 |
| 9,232,850 | B2 * | 1/2016 | Moreau | A45F 5/02 |
| 2004/0020959 | A1 * | 2/2004 | Sellars | A45F 5/00 224/675 |
| 2007/0205244 | A1 * | 9/2007 | Hewes, Jr. | A45F 5/02 224/674 |
| 2008/0149678 | A1 * | 6/2008 | Huang | A45F 5/02 224/666 |
| 2009/0188823 | A1 | 7/2009 | Zwergius | |

* cited by examiner

STEP BIT POUCH

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of holsters for carrying tools, small arms, or other accessories, more specifically, a holster with a belt loop adapted for use in carrying drill bits.

SUMMARY OF INVENTION

The step bit pouch is adapted for use with a plurality of step bits and a pilot bit. The step bit pouch is adapted for use with a belt. The step bit pouch is a holster that is designed to hold the plurality of step bits and the pilot bit. Each of the plurality of step bits are differentiated by their size. The intention of the step bit pouch is to provide a craftsman, such as an electrician, who only occasionally needs to work with sheet metal, a small, light, and convenient means to carry only the drill bits required for punching holes in sheet metal. In one potential embodiment of the disclosure, the step bit pouch accommodates a plurality of step bits comprising a first bit and a second bit.

These together with additional objects, features and advantages of the step bit pouch will be readily apparent to those of ordinary skill in the art upon reading the following detailed description of the presently preferred, but nonetheless illustrative, embodiments when taken in conjunction with the accompanying drawings.

In this respect, before explaining the current embodiments of the step bit pouch in detail, it is to be understood that the step bit pouch is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the step bit pouch.

It is therefore important that the claims be regarded as including such equivalent construction insofar as they do not depart from the spirit and scope of the step bit pouch. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
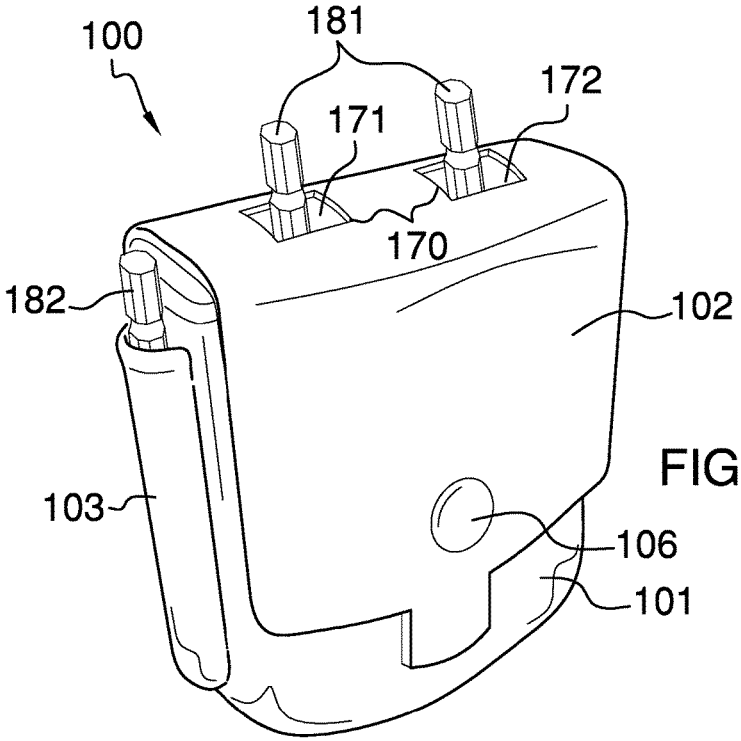
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 10.

The step bit pouch 100 (hereinafter invention) comprises a first textile or sheeting 101, a second textile or sheeting 102, a third textile or sheeting 103, a fourth textile or sheeting 104, a plurality of seams 105, and a fastener 106. The invention 100 is adapted for use with a plurality of step bits 181 and a pilot bit 182. The invention 100 is adapted for use with a belt 183. The invention 100 is a holster that is designed to hold a plurality of step bits 181 and a pilot bit 182. Each of the plurality of step bits 181 are differentiated by their size. The intention of the invention 100 is to provide a craftsman, such as an electrician, who only occasionally needs to work with sheet metal, a small, light, and convenient means to carry only the drill bits required for punching holes in sheet metal.

Figure 6:
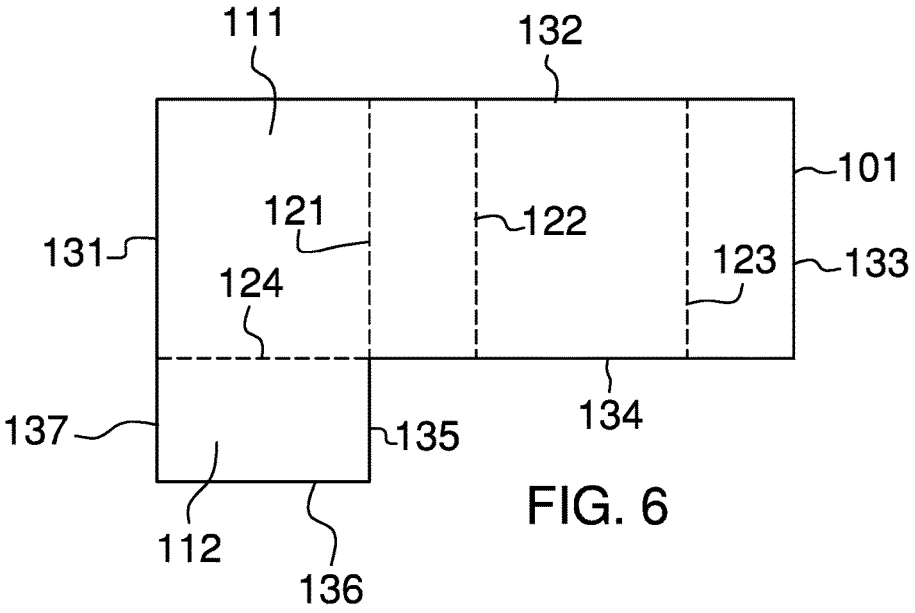
FIG. 6 is a detail view of an embodiment of the disclosure.

As shown in FIG. 6, the first textile or sheeting 101 is formed in the shape of a rectilinear structure that is further described with a first rectangle 111 and a second rectangle 112. The first textile or sheeting 101 is further defined with a first edge 131, a second edge 132, a third edge 133, a fourth edge 134, a fifth edge 135, a sixth edge 136, and a seventh edge 137. When the invention 100 is assembled, the first textile or sheeting 101 further comprises a first fold 121, a second fold 122, a third fold 123, and a fourth fold 124. The first rectangle 111 is defined by the perimeter described by the first edge 131, the second edge 132, the third edge 133, the fourth edge 134 and the fourth fold 124. The second rectangle 112 is defined by the perimeter described by the fifth edge 135, the sixth edge 136, the seventh edge 137 and the fourth fold 124.

The second rectangle 112 is positioned such that the seventh edge 137 is aligned with the first edge 131 and the fifth edge 135 is aligned with the first fold 121. The first fold 121 forms a line that runs from the corner formed by the fourth edge 134 and the fifth edge 135 to the second edge 132 such that the first fold 121 is perpendicular to the second edge 132 and the fourth edge 134. The second fold 122 forms a line that runs from the fourth edge 134 to the second edge 132 such that the second fold 122 is parallel to the first fold 121. The third fold 123 forms a line that runs from the fourth edge 134 to the second edge 132 such that the third fold 123 is parallel to the first fold 121 and the second fold 122 is between the third fold 123 and the first fold 121. The fourth fold 124 forms a line that runs from the corner formed by the fourth edge 134 and the fifth edge 135 to the first edge 131 such that the fourth fold 124 is perpendicular to the first edge 131 and the fifth edge 135. The first textile or sheeting 101 is used to form the container that will hold the plurality of step bits 181.

Figure 7:
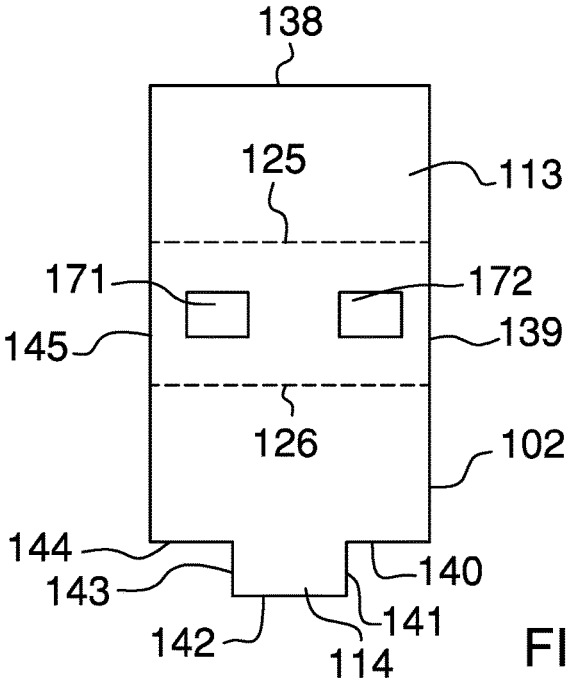
FIG. 7 is a detail view of an embodiment of the disclosure.

As shown in FIG. 7, the second textile or sheeting 102 is formed in the shape of a rectilinear structure that is further described with a third rectangle 113 and a fourth rectangle 114. The second textile or sheeting 102 is further defined with an eighth edge 138, a ninth edge 139, a tenth edge 140, an eleventh edge 141, a twelfth edge 142, a thirteenth edge 143, a fourteenth edge 144, and a fifteenth edge 145. When the invention 100 is assembled, the second textile or sheeting 102 further comprises a fifth fold 125 and a sixth fold 126. The third rectangle 113 is defined by the perimeter described by the eighth edge 138, the ninth edge 139, the tenth edge 140, the fourteenth edge 144, and a line that connects the fourteenth edge 144 and the tenth edge 140, and the fifteenth edge 145. The fourth rectangle 114 is defined by the perimeter described by the line that connects the fourteenth edge 144 and the tenth edge 140, the eleventh edge 141, the twelfth edge 142, and the thirteenth edge 143.

The fifth fold 125 forms a line that runs from the sixteenth edge 146 to the ninth edge 139 such that the fifth fold 125 is perpendicular to both the sixteenth edge 146 and the ninth edge 139. The sixth fold 126 forms a line that runs from the sixteenth edge 146 to the ninth edge 139 such that the sixth fold 126 is parallel to the fifth fold 125. The fourth rectangle 114 is positioned such that the fourth rectangle 114 projects perpendicularly away from the edge formed by the tenth edge 140, the fourteenth edge 144 and the line that connects the fourteenth edge 144 and the tenth edge 140. The fourth rectangle 114 is positioned such that the span of the tenth edge 140 equals the span of the fourteenth edge 144. The second textile or sheeting 102 further comprises a plurality of holes 170. Each of the plurality of holes 170 is located between the fifth fold 125 and the sixth fold 126. The second textile or sheeting 102 forms a cover for the container formed by the first textile or sheeting 101 and is attached to the first textile or sheeting 101.

Figure 8:
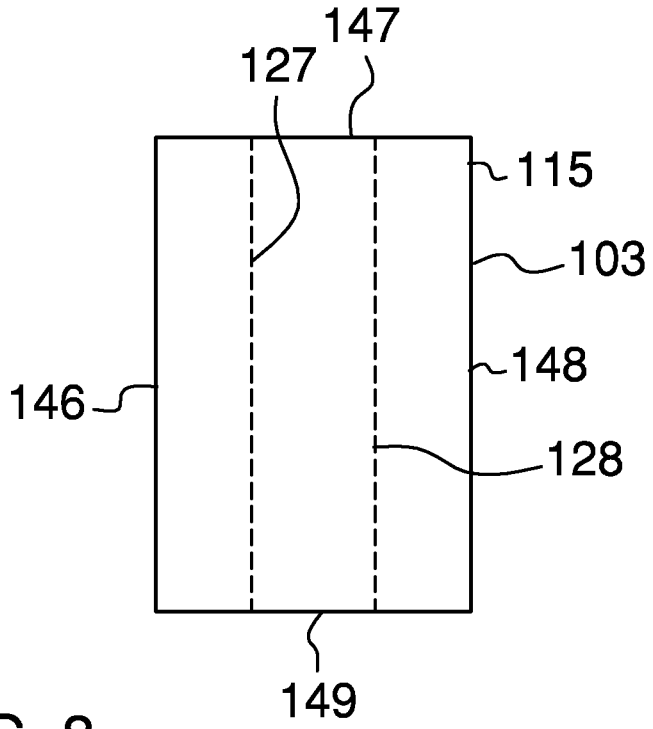
FIG. 8 is a detail view of an embodiment of the disclosure.

As shown in FIG. 8, the third textile or sheeting 103 is formed in the shape a fifth rectangle 115. The third textile or sheeting 103 is further defined with a sixteenth edge 146, a seventeenth edge 147, an eighteenth edge 148, and a nineteenth edge 149. When the invention 100 is assembled, the third textile or sheeting 103 further comprises a seventh fold 127 and an eighth fold 128. The seventh fold 127 forms a line that runs from the seventeenth edge 147 to the nineteenth edge 149 such that the seventh fold 127 is perpendicular to both the seventeenth edge 147 and the nineteenth edge 149. The eighth fold 128 forms a line that runs from the seventeenth edge 147 to the nineteenth edge 149 such that the eighth fold 128 is parallel to the seventh fold 127. The third textile or sheeting 103 forms a pocket that is attached to the first textile or sheeting 101 that contains the pilot bit 182.

Figure 9:
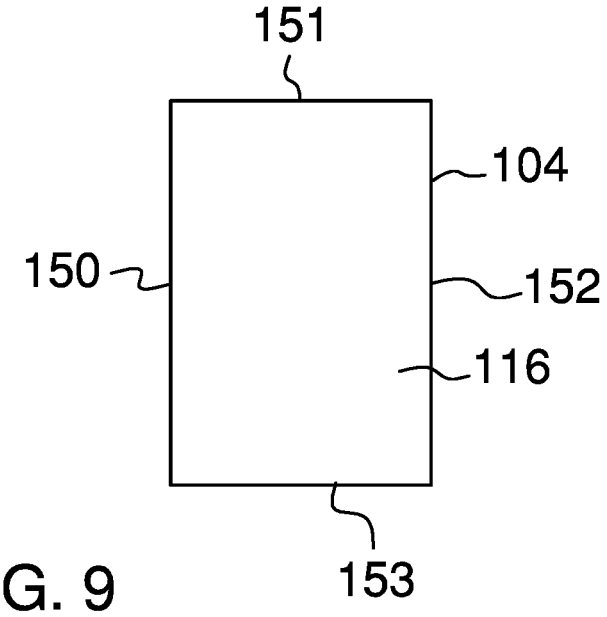
FIG. 9 is a detail view of an embodiment of the disclosure.

As shown in FIG. 9, the fourth textile or sheeting 104 is formed in the shape a sixth rectangle 116. The fourth textile or sheeting 104 is further defined with a twentieth edge 150, a twenty first edge 151, a twenty second edge 152, and a twenty third edge 153. The fourth textile or sheeting 104 forms a loop that is attached to the first textile or sheeting 101 that is used to attach a belt 183 to the invention 100.

The plurality of seams 105 further comprises a first seam 161, a second seam 162, a third seam 163, a fourth seam 164, a fifth seam 165, a sixth seam 166, a seventh seam 167, an eighth seam 168, and a ninth seam 169.

Figure 10:
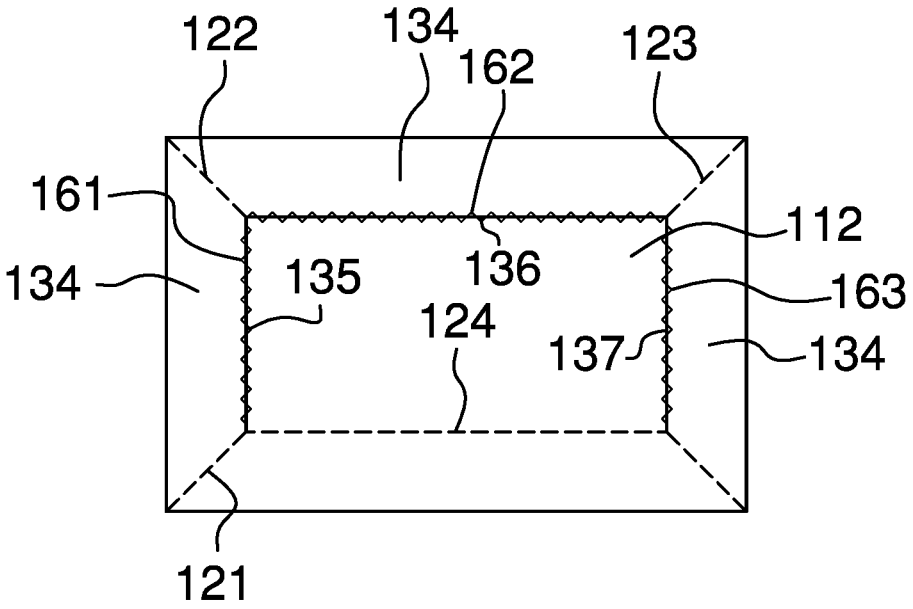
FIG. 10 is a detail view of an embodiment of the disclosure.

As shown most clearly in FIG. 10, the first textile or sheeting 101 is formed into the container by folding the first fold 121, the second fold 122, the third fold 123 and the fourth fold 124 in such a manner that the fourth edge 134 wraps around the fifth edge 135, the sixth edge 136, and the seventh edge 137 of the second rectangle 112. The first seam 161 secures the fourth edge 134 to the fifth edge 135. The second seam 162 secures the fourth edge 134 and the sixth edge 136. The third seam 163 secures the fourth edge 134 and the seventh edge 137.

Figure 2:
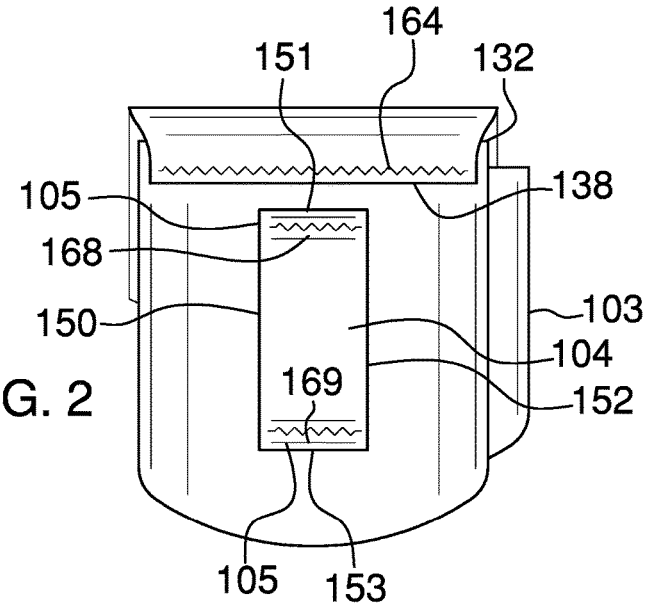
FIG. 2 is a back view of an embodiment of the disclosure.
Figure 3:
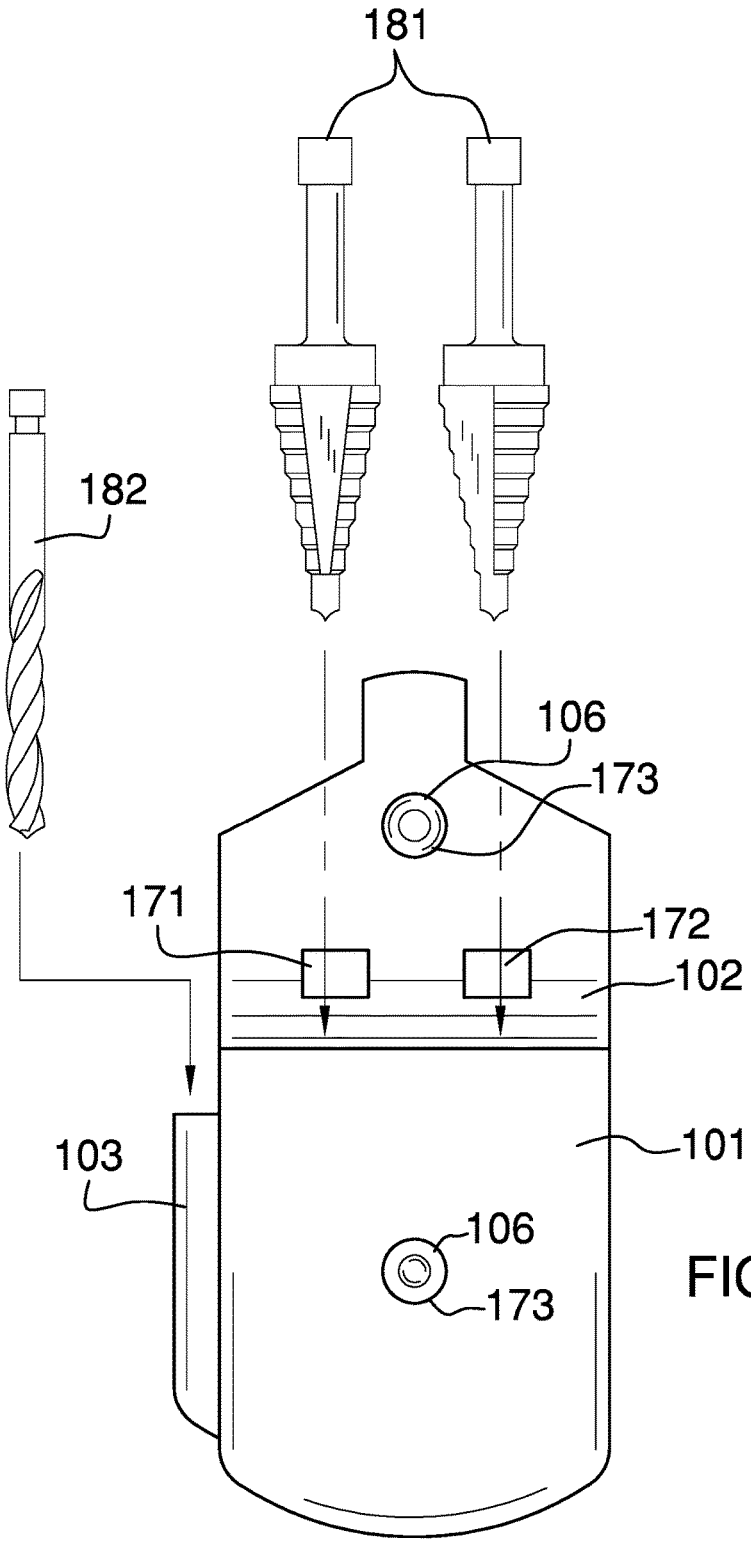
FIG. 3 is a front view of an embodiment of the disclosure.

As shown most clearly in FIG. 2, the eighth edge 138 of the second textile or sheeting 102 is attached to the first rectangle 111 of the first textile or sheeting 101 using the fourth seam 164. The eighth edge 138 of the second textile or sheeting 102 is attached to the first rectangle 111 of the first textile or sheeting 101 such that the fifth fold 125 will fold over the second edge 132. The sixth fold 126 also folds over a different segment of the second edge 132 thereby enclosing the container formed by the first textile or sheeting 101. The fastener 106 further comprises a first element 173 and a second element 174. The sixth fold 126 is folded such that the plurality of holes 170 form apertures that allow access into the container for the plurality of step bits 181. The first element 173 is attached to the first textile or sheeting 101. The second element 174 is attached to the second textile or sheeting 102 such that when the sixth fold 126 folds over the second edge 132, the first element 173 and the second element 174 align thus allowing the first element 173 and the second element 174 to be joined.

Figure 4:
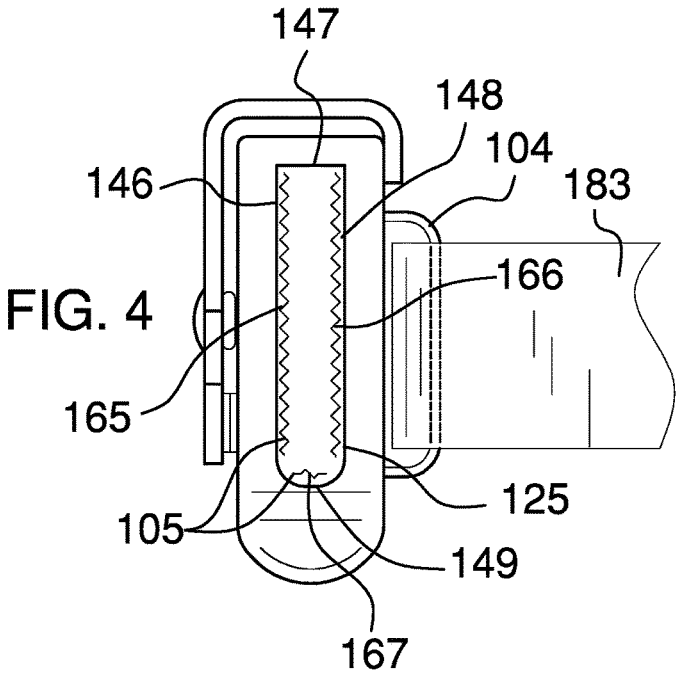
FIG. 4 is a side view of an embodiment of the disclosure.
Figure 5:
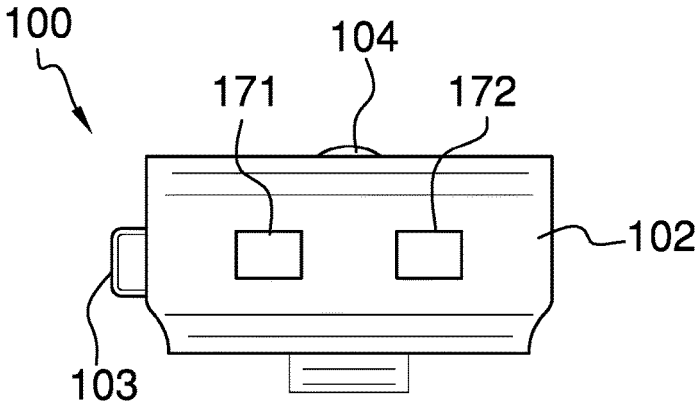
FIG. 5 is a top view of an embodiment of the disclosure.

As shown most clearly in FIG. 4, the third textile or sheeting 103 is attached to the first rectangle 111. The sixteenth edge 146 is attached to the first rectangle 111 using the fifth seam 165. The eighteenth edge 148 is attached to the first rectangle 111 using the sixth seam 166. The nineteenth edge 149 is attached to the first rectangle 111 using the seventh seam 167. The third textile or sheeting 103 is positioned on the first rectangle 111 such that the seventeenth edge 147 is proximal to the fourth edge 134. The seventh fold 127 and the eighth fold 128 are folded in the third textile or sheeting 103 such that a pouch is formed that will receive the pilot bit 182. The seventeenth edge 147 forms an opening into the pouch that is formed by the third textile or sheeting 103.

As shown most clearly in FIG. 2, the fourth textile or sheeting 104 is attached to the first rectangle 111. The twenty first edge 151 is attached to the first rectangle 111 using the eighth seam 168. The twenty third edge 153 is attached to the first rectangle 111 using the ninth seam 169. As shown most clearly in FIG. 4, when joined in this fashion, the fourth textile or sheeting 104 forms a loop that allows the belt 183 to be inserted in a space that is formed between the first textile or sheeting 101 and the fourth textile or sheeting 104.

In a first potential embodiment of the disclosure, the first textile or sheeting 101, the second textile or sheeting 102, the third textile or sheeting 103, and the fourth textile or sheeting 104 are formed from leather. Each of the plurality of seams 105 is a sewn seam. The plurality of holes 170 further comprises a first hole 171 and a second hole 172. The fastener 106 is a magnetic fastener wherein the first element 173 is a magnet and the second element 174 is a magnet. The first element 173 and the second element 174 are attached using an adhesive.

A second potential embodiment of the disclosure is identical to the first potential embodiment of the disclosure except that the fastener is a hook and loop fastener. The first element 173 is a first hook or loop surface and the second element 174 is a second hook or loop surface. The first element 173 and the second element 174 are attached using sewn seams.

The following definitions were used in this disclosure:

Fastener: As used in this disclosure, a fastener device that is used to join or affix two objects. Fasteners generally comprise a first element, which is attached to the first object and a second element, which attached to the second object such that the first element and the second element join to affix the first object and the second object.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface. A note on usage: when fastening a two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook and loop fastener or the loop surface of a hook and loop fastener is attached to an object this will simply be referred to as the "hook or loop surface" with the understanding that when the two objects are fastened together one of the two objects will have a hook surface and the remaining object will have the loop surface.

Loop: As used in this disclosure, a loop is the length of a first linear structure including, but not limited to, lines, cords, or ribbons, that are: 1) folded over and joined at the ends forming an enclosed space; of, 2) curved to form a closed or nearly closed space within the first linear structure. In both cases, the space formed within the first linear structure is such that a second linear structure such as a line, cord or a hook can be inserted through the space formed within the first linear structure.

Perimeter: As used in this disclosure, a perimeter is one or more curved or straight lines that bounds an enclosed area on a plane or surface. The perimeter of a circle is commonly referred to as a circumference.

Rectilinear: As used in this disclosure, rectilinear is an adjective that is used to describe an object that: 1) moves in a straight line or lines; 2) consists of a straight line or lines; 3) is bounded by a straight line or lines; or, 4) is otherwise characterized by a straight line or lines Seam: As used in this disclosure, a seam is a joining of: 1) a first textile to a second textile; 2) a first sheeting to a second sheeting; or, 3) a first textile to a first sheeting.

Sewn Seam: As used in this disclosure, a sewn seam a method of attaching two or more layers of textile, leather, or other material through the use of a thread, a yarn, or a cord that is repeatedly inserted and looped through the two or more layers of textile, leather, or other material.

Sheeting: As used in this disclosure, sheeting is a material, such as cloth, leather or plastic, in the form of a thin flexible layer or layers.

Textile: As used in this disclosure, a textile is a material that is woven, knitted, braided or felted. Synonyms in common usage for this definition include fabric and cloth.

For purposes of simplicity the claims below shall use the term textile to define the first textile, the second textile, the third textile, etc. However, it shall be noted that the actual material being used may be a sheeting.

With respect to the above description, it is to be realized that the optimum dimensional relationship for the various components of the invention described above and in FIGS. 1 through 10, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A holster comprising:

a first textile, a second textile, a third textile, a fourth textile, a plurality of seams, and a fastener;

wherein the first textile, the second textile, the third textile, and the fourth textile are adjoined using the plurality of seams;

wherein the fastener adjoins the first textile and the second textile;

wherein the holster is adapted for use with a plurality of step bits and a pilot bit;

wherein the holster is adapted for use with a belt;

wherein the holster holds the plurality of step bits and the pilot bit;

wherein the first textile is formed in the shape of a rectilinear structure;

wherein the first textile is further described with a first rectangle and a second rectangle;

wherein the first textile is further defined with a first edge, a second edge, a third edge, a fourth edge, a fifth edge, a sixth edge, and a seventh edge;

wherein the first textile further comprises a first fold, a second fold, a third fold, and a fourth fold;

wherein the first rectangle is defined by the perimeter described by the first edge, the second edge, the third edge, the fourth edge, and the fourth fold;

wherein the second rectangle is defined by the perimeter described by the fifth edge, the sixth edge, the seventh edge, and the fourth fold;

wherein the second rectangle is positioned such that the seventh edge is aligned with the first edge and the fifth edge is aligned with the first fold.

2. The holster according to claim 1 wherein the first fold forms a line that runs from the corner formed by the fourth edge and the fifth edge to the second edge such that the first fold is perpendicular to the second edge and the fourth edge;

wherein the second fold forms a line that runs from the fourth edge to the second edge such that the second fold is parallel to the first fold;

wherein the third fold forms a line that runs from the fourth edge to the second edge such that the third fold is parallel to the first fold;

wherein the third fold forms a line that runs from the fourth edge to the second edge such that the second fold is between the third fold and the first fold;

wherein the fourth fold forms a line that runs from the corner formed by the fourth edge and the fifth edge to the first edge such that the fourth fold is perpendicular to the first edge and the fifth edge.

3. The holster according to claim 2 wherein the second textile is formed in the shape of a rectilinear structure that is further described with a third rectangle and a fourth rectangle;

wherein the second textile is further defined with an eighth edge, a ninth edge, a tenth edge, an eleventh edge, a twelfth edge, a thirteenth edge, a fourteenth edge, and a fifteenth edge;

wherein the second textile further comprises a fifth fold and a sixth fold;

wherein the third rectangle is defined by the perimeter described by the eighth edge, the ninth edge, the tenth edge, the fourteenth edge, a line that connects the fourteenth edge and the tenth edge, and the fifteenth edge;

wherein the fourth rectangle is defined by the perimeter described by the line that connects the fourteenth edge and the tenth edge, the eleventh edge, the twelfth edge, and the thirteenth edge.

4. The holster according to claim 3 wherein the fifth fold forms a line that runs from the sixteenth edge to the ninth edge such that the fifth fold is perpendicular to both the sixteenth edge and the ninth edge;

wherein the sixth fold forms a line that runs from the sixteenth edge to the ninth edge such that the sixth fold is parallel to the fifth fold;

wherein the fourth rectangle is positioned such that the fourth rectangle projects perpendicularly away from the edge formed by the tenth edge, the fourteenth edge and the line that connects the fourteenth edge and the tenth edge;

wherein the fourth rectangle is positioned such that the span of the tenth edge equals the span of the fourteenth edge.

5. The holster according to claim 4 wherein the second textile further comprises a plurality of holes;

wherein each of the plurality of holes is located between the fifth fold and the sixth fold.

6. The holster according to claim 5 wherein the third textile is formed in the shape a fifth rectangle;

wherein the third textile is further defined with a sixteenth edge, a seventeenth edge, an eighteenth edge, and a nineteenth edge;

wherein the third textile further comprises a seventh fold and an eighth fold.

7. The holster according to claim 6 wherein the seventh fold forms a line that runs from the seventeenth edge to the nineteenth edge such that the seventh fold is perpendicular to both the seventeenth edge and the nineteenth edge;

wherein the eighth fold forms a line that runs from the seventeenth edge to the nineteenth edge such that the eighth fold is parallel to the seventh fold.

8. The holster according to claim 7 wherein the fourth textile is formed in the shape a sixth rectangle;

wherein the fourth textile is further defined with a twentieth edge, a twenty first edge, a twenty second edge, and a twenty third edge;

wherein the fourth textile forms a loop that is attached to the first textile.

9. The holster according to claim 8 wherein the plurality of seams further comprises a first seam, a second seam, and a third seam;

wherein the first fold, the second fold, the third fold and the fourth fold are folded in such a manner that the fourth edge wraps around the fifth edge, the sixth edge, and the seventh edge of the second rectangle;

wherein the first seam secures the fourth edge to the fifth edge;

wherein the second seam secures the fourth edge and the sixth edge;

wherein the third seam secures the fourth edge and the seventh edge.

10. The holster according to claim 9 wherein the plurality of seams further comprises a fourth seam;

wherein the eighth edge of the second textile is attached to the first rectangle of the first textile using the fourth seam;

wherein the eighth edge of the second textile is attached to the first rectangle of the first textile such that the fifth fold will fold over the second edge;

wherein the eighth edge of the second textile is attached to the first rectangle of the first textile such that the sixth fold folds over a different segment of the second edge.

11. The holster according to claim 10 wherein the plurality of seams further comprises a fifth seam, a sixth seam, and a seventh seam;

wherein the third textile is attached to the first rectangle;

wherein the sixteenth edge is attached to the first rectangle using the fifth seam;

wherein the eighteenth edge is attached to the first rectangle using the sixth seam;

wherein the nineteenth edge is attached to the first rectangle using the seventh seam;

wherein the third textile is positioned on the first rectangle such that the seventeenth edge is proximal to the fourth edge;

wherein the seventh fold and the eighth fold are folded in the third textile such that a pouch is formed;

wherein the seventeenth edge forms an opening into the pouch.

12. The holster according to claim 11 wherein the plurality of seams further comprises, an eighth seam and a ninth seam;

wherein the fourth textile is attached to the first rectangle;

wherein the twenty first edge is attached to the first rectangle using the eighth seam;

wherein the twenty third edge is attached to the first rectangle using the ninth seam;

wherein the fourth textile forms a loop.

13. The holster according to claim 12 wherein the fastener further comprises a first element and a second element;

wherein the first element is attached to the first textile;

wherein the second element is attached to the second textile;

wherein the second element is attached to the second textile such that the first element and the second element align when the sixth fold folds over the second edge.

14. The holster according to claim 13 wherein each of the plurality of seams is a sewn seam.

15. The holster according to claim 13 wherein the first textile is formed from leather;

wherein the second textile is formed from leather;

wherein the third textile is formed from leather;

wherein the fourth textile is formed from leather.

16. The holster according to claim 15 wherein each of the plurality of seams is a sewn seam.

17. The holster according to claim 16 wherein the fastener is a magnetic fastener.

18. The holster according to claim 16 wherein the fastener is a hook and loop fastener.

* * * * *